US006105406A

United States Patent [19]

Thompson et al.

[11] Patent Number: 6,105,406

[45] **Date of Patent: *Aug. 22, 2000**

[54] LATCH SECURITY DEVICE

[76] Inventors: Stephen G. Thompson, 1871 Walkley Rd., Ottawa, Ontario, Canada, K1H 6X9; Mark W. Forest, 49 Otten Drive, Nepean, Ontario, Canada, K2J 2L1

[ * ] Notice: This patent issued on a continued prosecution application filed under 37 CFR 1.53(d), and is subject to the twenty year patent term provisions of 35 U.S.C. 154(a)(2).

[21] Appl. No.: 09/110,236

[22] Filed: Jul. 6, 1998

[30] Foreign Application Priority Data

Jul. 10, 1997 [CA] Canada ..... 2210187

[51] Int. Cl.[7] ..... E05B 13/00

[52] U.S. Cl. ..... 70/416; 70/211; 70/DIG. 58; 292/DIG. 2

[58] Field of Search ..... 70/416, DIG. 58, 70/429, 430, 211, 212, 38 A; 292/DIG. 2, 288

[56] References Cited

U.S. PATENT DOCUMENTS

| | | | |
|---|---|---|---|
| 2,463,195 | 3/1949 | Mungan | 70/416 |
| 3,724,246 | 4/1973 | Katsaros | 70/431 |
| 3,748,882 | 7/1973 | Dusault, Jr. et al. | 70/416 |
| 3,826,117 | 7/1974 | Racobs | 70/416 |
| 3,927,544 | 12/1975 | Klein | 70/416 |
| 4,055,361 | 10/1977 | Moses | 292/359 |
| 4,152,911 | 5/1979 | Sharma | 70/416 |
| 4,279,137 | 7/1981 | Cook | 70/416 |
| 4,413,492 | 11/1983 | Strange | 70/416 |
| 4,673,202 | 6/1987 | Willis | 292/162 |
| 4,827,745 | 5/1989 | Baugh | 70/416 |
| 4,869,086 | 9/1989 | Richards | 70/416 |
| 4,885,921 | 12/1989 | Sharav | 70/159 |
| 5,003,803 | 4/1991 | Richards | 70/416 |
| 5,007,263 | 4/1991 | Taylor | 70/416 |
| 5,052,202 | 10/1991 | Murphy | 70/211 |
| 5,067,334 | 11/1991 | Sorkilmo | 70/416 |
| 5,072,976 | 12/1991 | Meszaros | 292/207 |
| 5,313,812 | 5/1994 | Eklund et al. | 70/416 |
| 5,369,971 | 12/1994 | Sheppard | 70/416 |
| 5,417,092 | 5/1995 | Iu | 70/38 A |
| 5,421,074 | 6/1995 | Moore | 29/401.1 |
| 5,515,704 | 5/1996 | Van Nguyen | 70/416 |
| 5,651,279 | 7/1997 | Berton et al. | 70/211 |

*Primary Examiner*—Darnell M. Boucher
*Assistant Examiner*—Clifford B Vaterlaus
*Attorney, Agent, or Firm*—Charles P. Boukus, Jr.

[57] ABSTRACT

Disclosed is a security device for securement to a door in association with a latch mechanism having a face plate and knob to selectively prevent unauthorized turning of the latch mechanism and knob. The device includes a plate for securement to the door in association with the face plate of the latch mechanism. A hood element selectively prevents rotation of the latch knob, the hood element being reciprocable relative to the plate means into and out of engagement with the latch knob. The plate and the hood element preventing rotation include cooperating locking mechanisms when the hood element is brought into contact with the latch knob. There is also a release mechanism for releasing the locking mechanisms. Preferably the locking mechanisms are of the pawl and ratchet type.

11 Claims, 3 Drawing Sheets

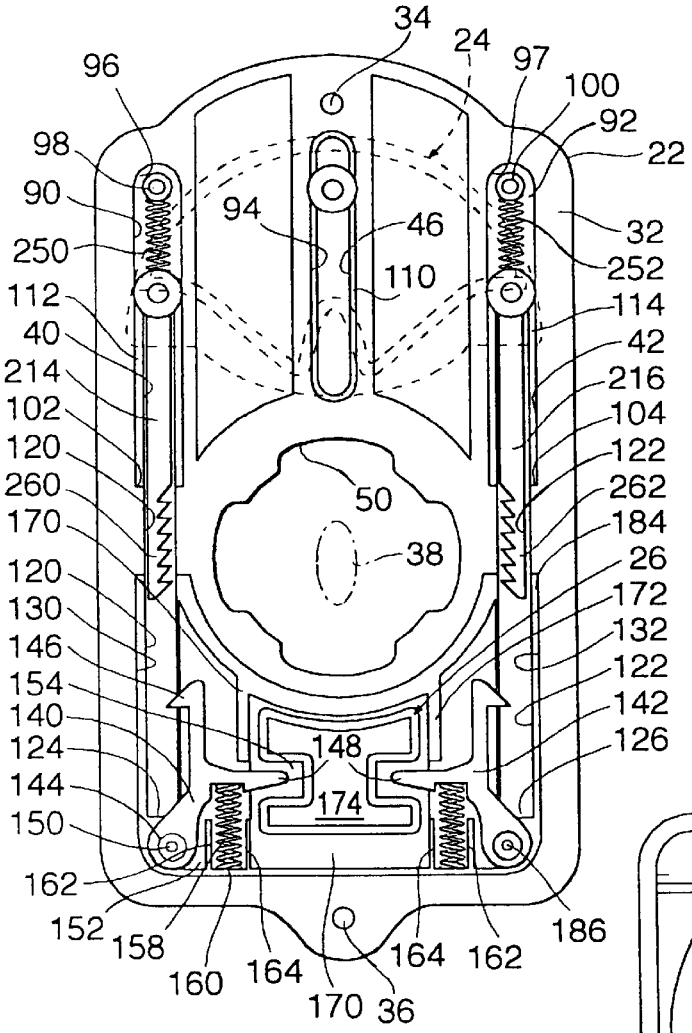
FIG. 6
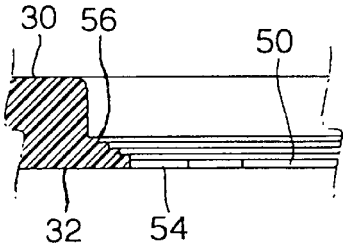
FIG. 4
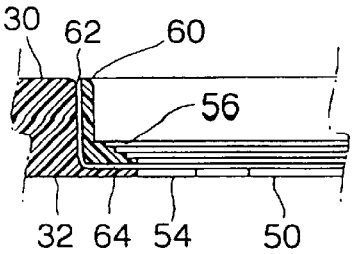
FIG. 5
FIG. 3
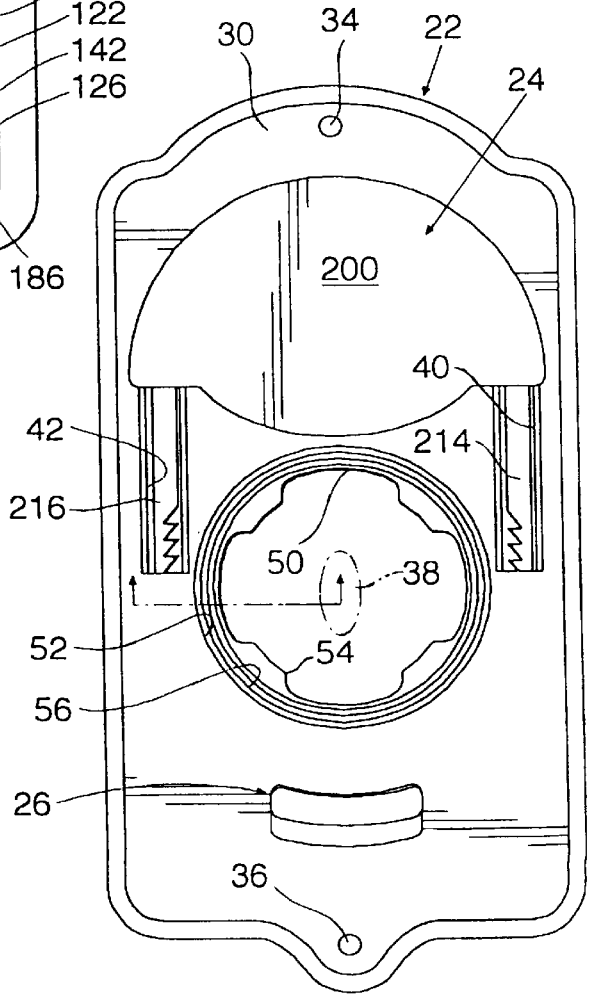

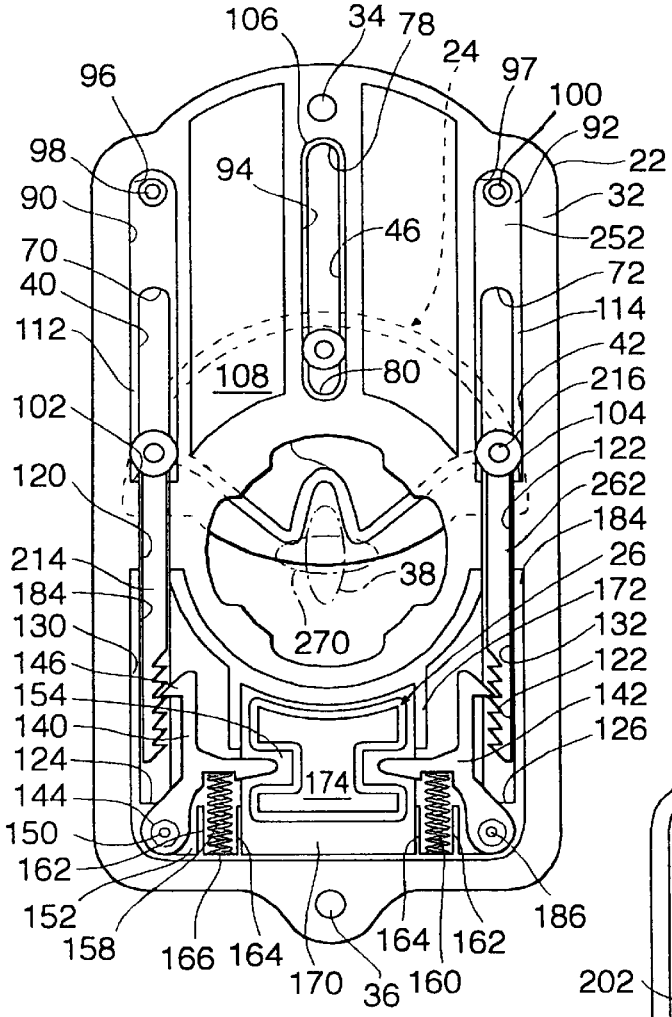
FIG. 10
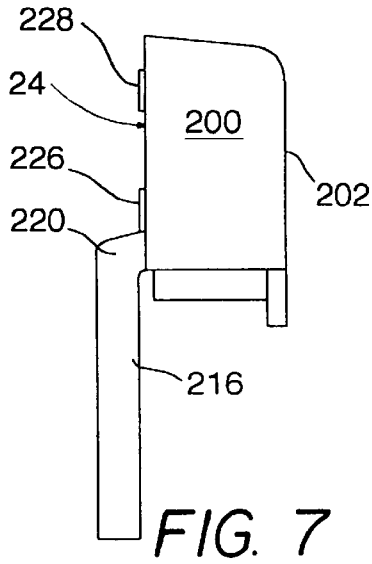
FIG. 7
FIG. 9
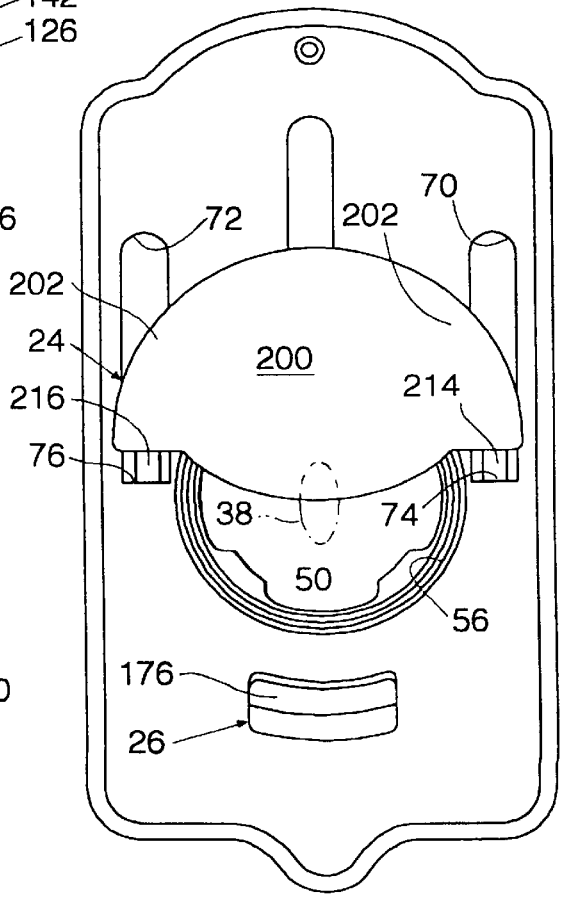
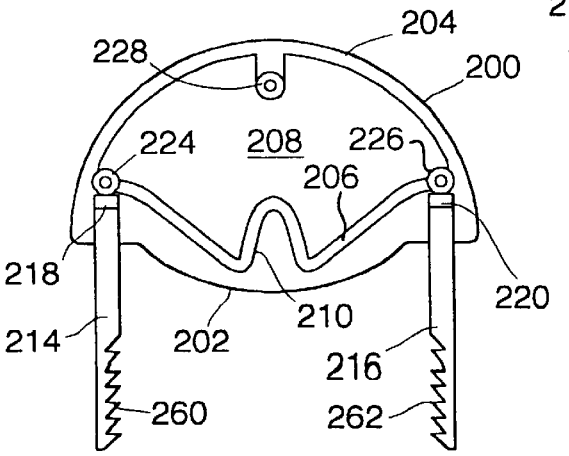
FIG. 8

LATCH SECURITY DEVICE

FIELD OF THE INVENTION

This invention relates to a latch security device to be associated with the latch knob of a door lock or the latch of a deadbolt lock to prevent unauthorized turning of the knob from the outside.

BACKGROUND OF THE INVENTION

Locks and latch mechanisms have become more sophisticated in the last several years. However, the devices and techniques used by persons wishing to gain illegal or non-permitted access to buildings, apartment houses and the like have also become more sophisticated. There have been several proposals to provide security devices for such locks which in essence prevent the turning of the latch knob from the outside.

Exemplary of these devices are U.S. patents to SHARMA, U.S. Pat. No. 4,152,911, May 8, 1979; COOK, U.S. Pat. No. 4,279,137, Jul. 21, 1981 and RICHARDS, U.S. Pat. No. 4,869,086, Sep. 26, 1989. The Sharma device is pivotally mounted to the door for movement into and out of interference with movement of the latch knob. The Cook device comprises a piece of plastic having a knob encompassing portion and a door handle encompassing portion. When the knob is turned, the device, which would tend to be turned with the knob, is prevented by cooperation between the handle and the handle encompassing portion of the device. The Richards device uses a VELCRO® type of material as part of its mechanism to secure the latch turning device to the latch knob associated with the door or handle.

Notwithstanding these prior art devices, a simple device which can be secured to the door and which selectively locks with the latch knob, but which can be easily released, is desirable.

SUMMARY OF THE INVENTION

The security device of this invention provides a device which is secured to the door in association with a latch knob which may be rotated by a key or any other means from outside the door. The device includes a retractable hood element which reciprocates into and out of abutment or engagement with the latch knob.

The invention in one aspect provides a security device for securement to a door in association with a latch mechanism having a face plate and knob to selectively prevent unauthorized turning of the latch mechanism and knob comprising plate means for securement to the door in association with the face plate of the latch mechanism, means for selectively preventing rotation of the latch knob, the means being reciprocable relative to the plate means into and out of engagement with the latch knob, the plate means and the means preventing rotation including cooperating locking mechanisms when the means for preventing rotation is brought into contact with the latch knob and means for releasing the locking mechanisms.

More particularly, the device including a base plate and a latch knob lock element which reciprocates into and out of contact with the knob. The hood element includes legs with ratchet latch for cooperation with biased pawl mechanisms, the pawl mechanisms being selectively released by a release lever or button.

Other aspects and features of the invention will become apparent from the description herein of a preferred embodiment of the invention.

BRIEF DESCRIPTION OF THE DRAWINGS

FIG. 3 is a front elevational view of the device showing the device in its dormant and unlatched position.

FIG. 4 is a partial sectional view taken along line 4—4 of FIG. 3 showing the stepped face plate aperture.

FIG. 5 is a view similar to FIG. 4 but of a modification of the face plate aperture.

FIG. 6 is a rear elevational view of the device as shown in FIG. 3.

FIG. 7 is a side view of the hood element of the security device.

FIG. 8 is a back view of the hood element of the security device.

FIG. 9 is a front elevational view of the device in latched position with a latch shown in phantom lines.

FIG. 10 is a rear elevational view of the device shown in FIG. 9.

DESCRIPTION OF A PREFERRED EMBODIMENT OF THE INVENTION

The security device 20 comprises a plate 22, a reciprocable latch knob lock 24 and a release lever 26.

Figure 1:
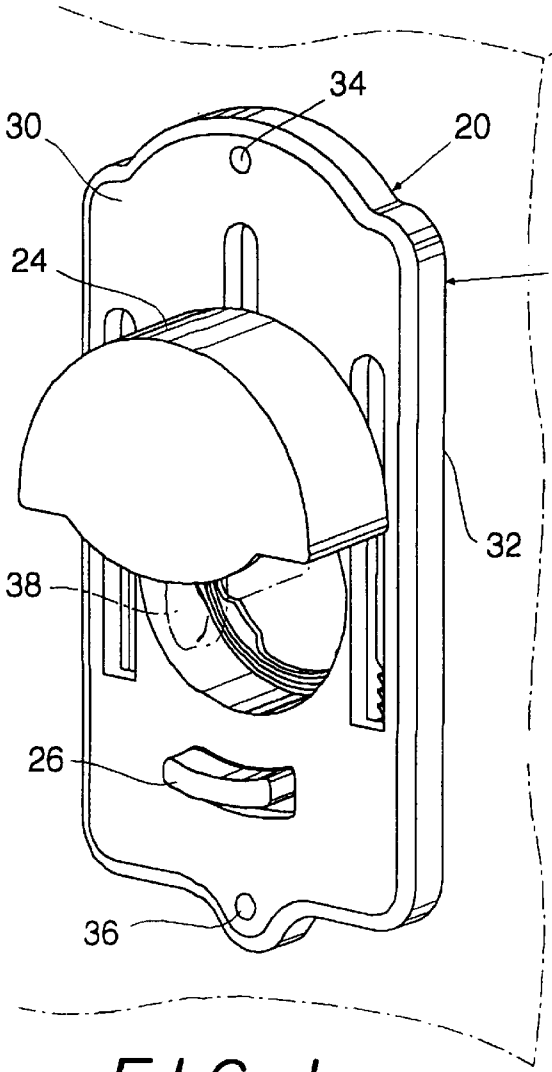
FIG. 1 is a perspective view of the latch security device of the invention.

More particularly as shown in FIG. 1, plate 22 has front and back faces 30, 32 and upper and lower apertures 34, 36 adapted to accept a fastener, such as a screw (not shown) for fastening device 20 to a door, shown schematically in phantom lines 37, and in association with a latch 38, also shown in phantom lines.

Plate 22 has parallel, elongate slots 40, 42 and 44 and lever opening 46. Slots 42 and 44 are laterally spaced slots, with slot 46 centered above a generally circular aperture 50 in plate 22. Aperture 50 has front circular aperture portion 52, rear cruciform aperture portion 54 and a stepped interior wall 56 adjacent portion 54. Aperture 50 is of a diameter to accept a face plate of the latch mechanism, (not shown) and to further secure the device to a door. The interior profile of wall 56 of aperture 50 between front aperture 52 and cruciform rear portion 54 is circumferentially stepped at 56 thereby providing for the centering of face plates of latches of different diameters. This profile of aperture 50 is best seen in partial sectional view, FIG. 4.

It will be seen that stepped circular portion 56 permits face plates of different diameters to center the device. It will be appreciated that this profile can be changed depending on the diameter of the face plates of latches in the marketplace. As an alternative, FIG. 5 shows a similar sectional view to that in FIG. 4 wherein the wall profile 56 is part of an insert 60 which fits within recess 62 created by plate 30 and flange 64 of cruciform portion 54. The profile of such an insert can be varied depending on the variation of face plates in the marketplace or newly introduced into the marketplace.

Figure 2:
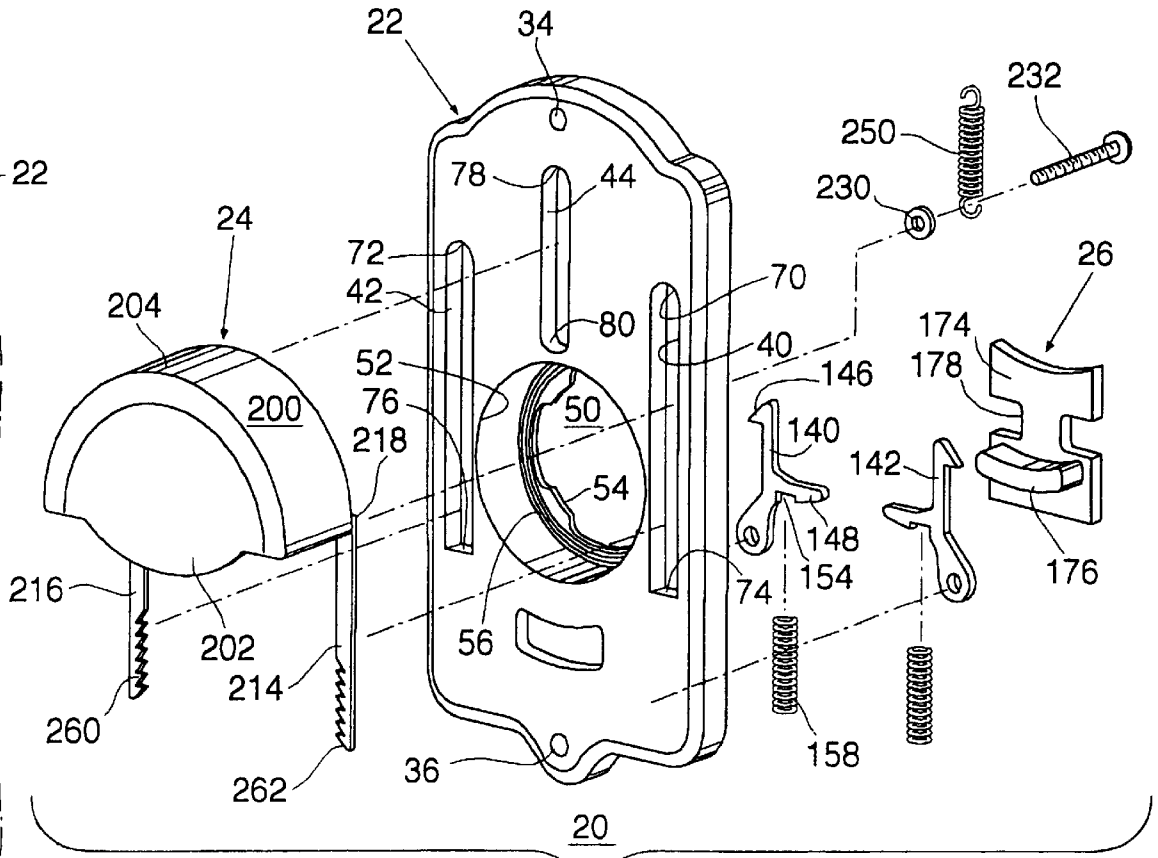
FIG. 2 is an exploded view of the main parts of the device.

As shown in FIGS. 2, 6 and 10, slots 40 and 42 have upper semi-circular ends 70, 72 respectively and rectangular lower ends 74, 76 respectively.

Slot 44 has upper and lower semi-circular ends 78, 80.

Back face 32 of latch plate 22 has longitudinal recesses 90, 92 and 94, which are in front-to-back longitudinal association with slots 40, 42 and 44 respectively. Recesses 90, 92 have upper semi-circular ends 96, 97 respectively with co-axial posts 98, 100 and have lower curved ends 102, 104 respectively. The width of recess 94 is slightly larger than the width of slot 44 thereby defining inner peripheral flange 110. Similarly, the width of recesses 90, 92 are slightly larger respectively than the width of slots 40, 42 to provide lateral flanges 112 and 114 respectively.

Longitudinally below recesses 90 and 92, there are slightly narrower elongate grooves 120, 122 which extend to rectangular ends 124, 126 (FIGS. 3 and 6). Within cavities 130, 132 below grooves 120, 122 and associated with the lower end of plate 22, there are pawls 140, 142 which are mirror images of each other and therefor only one pawl, 140, need be described in detail. Pawl 140 has pivot bore 144, pawl tooth end 146 and release arm 148.

Pawl 140 pivots via bore 144 on plate post 150 in circular recess portion 152 of cavity 130. Pawl tooth end 140 extends into the plane of longitudinal groove 120. Release arm 148 extends laterally away from the direction of pawl tooth 146 and includes recess 154 for accommodating end 156 of compression spring 158.

Back face 32 also includes a recess 160 defined by partitions 162, 164 to hold the other end 166 of spring 158.

Partitions 170, 172 which define in part cavities 130, 132 respectively, are each opposite a partition 164 and cooperate therewith to define a central channel 170 in which the back 174 of release lever 26 reciprocates, the front tongue 176 of which extends through opening 46. Lever back 174 has laterally spaced mirror image recesses 178 adapted to accept pawl release arms 148.

A plate 184, (shown transparent but it need not be), is secured to the back with screw fasteners 186 (only one being shown) cooperating with pawl pivot posts 150. Plate 184 fits within the periphery of similar shaped cavities 130, 132 in the back face 32 to cover the lower recessed portions thereof where the pawls 140 and release lever 26 are located.

Turning to FIGS. 2, 7 and 8, latch knob lock 24 has semi-circular hood portion 200 with outer or front face 202, peripheral side wall 204 and lower wall 206, the walls 204, 206 defining a rear cavity 208. Lower wall 206 provides structural strength to hood portion 200 and is configured to define a central, upwardly directed recess 210. Ratchet legs 214, 216 extend rearwardly and downwardly of hood portion 200 and are mirror images of each other. The upper ends 218, 220 of legs 214, 216 curve into the back of hood portion 200 whereby the legs are rearwardly offset from hood portion 200. As shown in FIG. 8, hood portion 200 also has three bosses extending rearwardly, bosses 224, 226 located just above the upper ends 218, 220 of legs 214, 216 respectively and associated with the juncture of walls 204 and 206. The boss 228 is centered above and between bosses 224, 226 and in association with wall 204. Each of the three bosses 224, 226 and 228 has a diameter adapted to move within slots 40, 42 and 44 respectively. Each of the bosses has a washer 230 held by screw 232 (FIGS. 6 and 10), which washer 230 runs in the associated slot and cooperates with the shoulders or flanges 112, 114, 110 to secure lock element 24 for reciprocal motion relative to plate 22. Once element 24 is located for in reciprocal securement with plate 22, tension springs 250, 252 are secured over posts 98, 100 respectively and to screws 232 associated with bosses 218, 220, thereby providing an upward bias to lock element 24, so that it will return to an upper position relative to plate 22 when released.

The lower ends 260, 262 of ratchet legs 214, 216 have teeth 264, 266 respectively for cooperation and engagement with respective pawl teeth 146. Legs 214, 216 move or travel within and in a path defined by grooves 120, 122.

In assembling lock 24 and lever 26 to plate 22, ratchet legs 214, 216 are inserted through respective slots 40, 42 in plate 22 and within longitudinal recesses 120, 122. An end of springs 250, 252 is secured over each post 98 and 100 and then secured respectively to aligned boss 224, 226 through the screws of the washer and screw assembly 230, 232. The securement of the springs 250, 252 to posts 98, 100 is by way of one end of the springs encircling the respective posts. Securing the other end of springs 250, 252 to bosses 224, 226 is over the washer 230 and attached by the screw 232 to the respective boss, the washer riding on the flanges or shoulders 112, 114 within the recess 90, 92 to retain the bosses 224, 226 within the respective slots 40, 42. Similarly, boss 228 is retained within slot 44 by a washer and screw assembly 230, 232, the washer riding on flange 110 within recess 44.

Release lever front portion 176 is inserted through plate opening 46 and is located within channel 170. Pawls 140 are located over posts 150 and springs 158 located within recesses 154 and 160 thereby biasing pawls to the position shown in FIG. 6. Back plate 184 is secured to back face 32 by screws 186 associated with posts 150, thereby retaining lever 26 and pawls 140, 142 in place.

For installation, a latch face plate, not shown, is first removed from the door and the latch securing device 20 is then located over the opening in the door associated with the latch face plate. The face plate is then re-assembled in the aperture 50 over the stepped shoulders 56 and reattached to the latch mechanism to provide securement of the device to the door, the stepped portion 56 being wedged between the face plate and door. Screws (not shown) may also be used to secure the device 20 to a door through apertures 34 and 36.

Once installed, the lock hood 200 is simply gripped and pulled down so that ratchet teeth 260, 262 of ratchet legs 214, 218 cooperate with pawl teeth 146, 148 to lock the hood 200 down on the door latch knob 38 as shown in FIGS. 9 and 10. To release the hood 200, the front 176 of lever 26 is pulled down causing pawls 140, 142 to be pivoted away from ratchet teeth 260, 262 whereby springs 250, 252 retract hood 200 upwardly to its non-locked position.

In FIG. 10, there-is shown a latch 270 in dot-dash lines which is horizontal rather than vertical. If the latch mechanism on a door is such that the latch mechanism is open when the knob is vertical and locked when horizontal, it will be apparent that the security device 20 is still effective since the walls 206 and 210 prevent rotation of the latch 270 from the horizontal to the vertical when the lock element 24 is in operative locking position with the knob.

Although I have set forth a preferred embodiment of the invention, it will be appreciated by those skilled in the art that variations are possible and I claim all variations which fall within the scope of the appended claims.

The embodiments of the invention in which an exclusive property or privilege is claimed are defined as follows:

1. A security device for securement to a door in association with a latch mechanism having a face plate and knob to selectively prevent unauthorized turning of the latch mechanism and knob comprising:

a plate member for securement to the door in association with the face plate of said latch mechanism;

means for selectively preventing rotation of said latch knob, said knob rotation prevention means being reciprocable relative to said plate member between a first position out of engagement with said latch knob and a second position in engagement with said latch knob;

said plate member and said knob rotation prevention means including cooperating locking mechanisms whereby said knob rotation prevention means is locked in said second position when brought into contact with said latch knob;

means for selectively releasing said locking mechanisms whereby said knob rotation prevention means can return from said second position to said first position;

said plate member having a front face and rear face and having at least one elongate slot between said front face and rear face, said knob rotation prevention member comprising a knob lock element, said knob lock element having member cooperating with said at least one slot for defining reciprocal movement of said knob lock element relative to said plate member between said first position and said second position, member for retaining said lock element in reciprocal association with said plate member and means for biasing said lock element into said first position when said locking mechanisms are disengaged.

2. The security device according to claim 1, wherein said plate member has an aperture therein having at least a portion sized to accept said latch mechanism face plate and means associated with said aperture for cooperation with said latch mechanism face plate whereby said plate member can be secured to the door by said latch mechanism face plate when said latch mechanism face plate is secured to said latch mechanism.

3. The security device according to claim 2, wherein said means associated with said aperture for securing said plate member to the door comprises an inner stepped profile to said aperture whereby latch mechanism face plates of varying diameter can be accommodated by said aperture within the stepped profile to hold said plate member in securement with the door.

4. The security device according to claim 3, wherein the inner stepped profile of said aperture of said plate member is part of a removable insert adapted to be associated with the aperture of said plate member.

5. The security device according to claim 1, wherein said cooperating locking mechanisms comprise at least one ratchet member connected to one of said knob lock element and said plate member and a pawl element connected to the other of said knob lock element and said plate member for cooperative locking association with each other when said knob lock element is in said second position; said means for releasing said locking mechanisms moving each said pawl element out of engagement with its associated ratchet member whereby said knob lock element can return to said first position.

6. The security device according to claim 5, wherein said knob lock element has a front face and rear face; said at least one ratchet member comprising an elongate leg connected at one end to said lock element and rearwardly offset from said rear face of said lock element; and said rear plate face including a groove longitudinally aligned with said at least one slot within which groove said leg is confined to travel.

7. The security device according to claim 6, wherein each said pawl element includes a release arm; and said means for releasing said locking mechanisms includes means for cooperative connection to the release arm of each said pawl element to pivot each said pawl element out of engagement with said associated ratchet member; and means normally biasing each said pawl element into the path of travel of the associated ratchet member.

8. The security device according to claim 7, wherein said plate member has an aperture therein having at least a portion sized to accept said latch mechanism face plate and means associated with said aperture for cooperation with said latch mechanism face plate whereby said plate member can be secured to the door by said latch mechanism face plate when said latch mechanism face plate is secured to said latch mechanism.

9. The security device according to claim 8, wherein said means associated with said aperture for securing said plate member to the door comprises an inner stepped profile to said aperture, whereby latch mechanism face plates of varying diameter can be accommodated by said aperture within the stepped profile to hold said plate member in securement with the door.

10. A security device for securement to a door in association with a latch mechanism having a face plate and knob to selectively prevent unauthorized turning of the latch mechanism and knob comprising:

a plate member;

means for securing said plate member to the door adjacent the face plate of said latch mechanism;

means for selectively preventing rotation of said latch knob, said knob rotation prevention means including a knob lock element reciprocable relative to said plate member between a first position out of engagement with said latch knob and a second position wherein said knob lock element is in engagement with said latch knob;

means for biasing said lock element into said first position;

said plate member and said knob rotation prevention means including cooperating locking mechanisms whereby said knob lock element is locked in said second position when brought into contact with said latch knob;

means for selectively releasing said locking mechanisms whereby said knob lock element is returned from said second position to said first position by said biasing means;

said plate member having a front face and rear face and having at least one elongate slot between said front face and rear face, said knob rotation prevention means having means cooperating with said at least one slot for defining reciprocal movement of said knob lock element relative to said plate member between said first position and said second position and means for retaining said lock element in reciprocal association with said plate member.

11. The security device according to claim 10, wherein said cooperating locking mechanism comprises at least one ratchet member connected to one of said knob rotation prevention means and said plate member and a pawl element connected to the other of said knob rotation prevention means and said plate member for cooperative locking association with each other when said knob lock element is in said second position, said means for releasing said locking mechanisms moving each said pawl element out of engagement with its associated said ratchet member whereby said lock element can return to said first position.

* * * * *